US011338571B2

(12) United States Patent
Bechberger

(10) Patent No.: US 11,338,571 B2
(45) Date of Patent: May 24, 2022

(54) METHOD FOR CLEANING A PRINTING FLUID OFF A SURFACE OF AT LEAST ONE ROTATABLE COMPONENT OF A PRINTING MACHINE

(71) Applicants: HEIDELBERGER DRUCKMASCHINEN INTELECTUAL PROPERTY AG & CO. KG, Wiesloch (DE); microsonic GmbH, Dortmund (DE)

(72) Inventor: Thomas Bechberger, Oestringen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 186 days.

(21) Appl. No.: 16/509,818

(22) Filed: Jul. 12, 2019

(65) Prior Publication Data

US 2020/0016887 A1 Jan. 16, 2020

(30) Foreign Application Priority Data

Jul. 12, 2018 (DE) ..... 102018211601.6

(51) Int. Cl.
*B41F 33/16* (2006.01)
*B41F 35/00* (2006.01)

(52) U.S. Cl.
CPC ..... *B41F 33/16* (2013.01); *B41F 35/001* (2013.01)

(58) Field of Classification Search
CPC ..... B41F 33/16
USPC ..... 101/484
See application file for complete search history.

(56) References Cited

U.S. PATENT DOCUMENTS

| | | | | |
|---|---|---|---|---|
| 5,964,157 | A | 10/1999 | Hummel et al. | |
| 5,988,067 | A * | 11/1999 | Ishida | B41F 31/00 101/183 |
| 6,109,182 | A * | 8/2000 | Vestman | B41F 35/00 101/483 |
| 10,603,897 | B2 * | 3/2020 | Liu | B41F 35/02 |
| 2003/0097947 | A1 * | 5/2003 | Caruthers | G03G 15/0121 101/484 |
| 2005/0005790 | A1 * | 1/2005 | Price | B41F 31/20 101/350.4 |
| 2006/0117977 | A1 | 6/2006 | Vestman et al. | |
| 2012/0103221 | A1 * | 5/2012 | Stowe | B41N 3/006 101/483 |

(Continued)

FOREIGN PATENT DOCUMENTS

| | | | |
|---|---|---|---|
| DE | 19705632 | A1 | 9/1998 |
| DE | 102010053989 | A1 | 6/2012 |

(Continued)

*Primary Examiner* — Anthony H Nguyen
(74) *Attorney, Agent, or Firm* — Laurence A. Greenberg; Werner H. Stemer; Ralph E. Locher

(57) ABSTRACT

A method for cleaning a printing fluid off a surface of at least one rotatable component of a printing press includes selecting and executing one of a plurality of predefined cleaning operations in an automated way. The selection is made on the basis of a predefined mathematical model executed on a computer and, when the model is executed, a parameter corresponding to an amount of the printing fluid present on the surface is calculated. The improved cleaning method may be applied in all modes of operation of the printing press and in particular allows detergent, cleaning cloth, and/or water to be saved.

8 Claims, 3 Drawing Sheets

(56) References Cited

U.S. PATENT DOCUMENTS

2013/0064591 A1* 3/2013 Salalha ..... G03G 15/104
399/357

FOREIGN PATENT DOCUMENTS

EP 0654350 A1 5/1995
EP 1661702 A1 5/2006

* cited by examiner

METHOD FOR CLEANING A PRINTING FLUID OFF A SURFACE OF AT LEAST ONE ROTATABLE COMPONENT OF A PRINTING MACHINE

CROSS-REFERENCE TO RELATED APPLICATION

This application claims the priority, under 35 U.S.C. § 119, of German Patent Application DE 10 2018 211 601.6, filed Jul. 12, 2018; the prior application is herewith incorporated by reference in its entirety.

BACKGROUND OF THE INVENTION

Field of the Invention

The invention relates to a method for cleaning a printing fluid, such as printing ink or dampening fluid, off the surface of at least one rotatable component of a printing press, for instance a cylinder or roller.

The technical field of the invention is the graphic industry, in particular the field of cleaning cylinders and rollers in inking and/or dampening units in an automated way.

Description of the Related Art

In printing machines, e.g. lithographic offset printing presses, printing fluids such as printing inks, varnishes, and/or dampening fluids are processed and transferred to printing material such as sheets of paper. At given intervals, it is necessary to clean the printing fluids off cylinders and rollers in the printing presses. That may be the case, for instance, when a job change occurs and the following print job requires different printing inks.

German Patent Application DE 197 05 632 A1, corresponding to U.S. Pat. No. 5,964,157, discloses a method for washing at least a part of a printing unit in an offset printing press in a self-actuated controlled way. In that process, signals indicating positions of individual ink metering devices, signals from a vibrator roller, or signals indicating the rotary speed of an ink fountain roller are processed and the printing ink consumption is calculated in accordance with known mathematical relationships. Based on that consumption value, a signal is created in accordance with a pre-saved function, which may have been created empirically or by numerical modeling, between the frequency and/or the type of the washing process and the ink consumption, and the signal is then fed to a control unit of the washing device. Since the process is based on ink consumption, it is only capable of providing information on the condition of printing units that are active in the printing operation. Information on other modes of operation and conditions of printing units cannot be provided.

Moreover, it has often been found that in practice, a press operator frequently needs to manually stop a washing program that has automatically started because the washing program will not provide optimum washing results under the current conditions in the printing unit. The operator then needs to initiate a washing program that is better suited from their point of view or in their experience. Therefore, the press may not be operated by inexperienced operators. Another disadvantage is that such operator interruptions are time-consuming and therefore increase production costs. In addition, an operator may choose the wrong washing program.

SUMMARY OF THE INVENTION

It is accordingly an object of the invention to provide a method for cleaning a printing fluid off a surface of at least one rotatable component of a printing machine, which overcomes the hereinafore-mentioned disadvantages of the heretofore-known methods of this general type and which in particular automatically provides optimum cleaning results in all modes of operation of a printing press and the printing units thereof, in particular in the modes of printing operation, printing break, start-up of the press, sheet transport without printing, set-up process, etc.

With the foregoing and other objects in view there is provided, in accordance with the invention, a method for cleaning a printing fluid such as printing ink or dampening fluid and/or dirt such as paper dust off the surface of at least one rotatable component in a printing machine, for instance a cylinder or roller, wherein one of several predefined cleaning operations is selected and executed in an automated way, the selection is made on the basis of a predefined mathematical model executed on a computer, and when the model s executed, a parameter corresponding to a printing fluid amount present on the surface is calculated.

Advantageous and thus preferred further developments of the invention will become apparent from the dependent claims as well as from the description and drawings. The features of the invention, of the further developments of the invention, and of the exemplary embodiments of the invention may be combined with one another and such combinations also represent advantageous further developments of the invention.

The invention provides an improved cleaning process that in particular provides optimum cleaning results in all modes of operation of a printing press and the printing units thereof.

Another advantage of the invention is that the model-based calculation does not include calculation on the basis of ink consumption. Instead, a parameter that corresponds to the printing fluid amount that is present on the surface is calculated. In addition, a parameter that corresponds to the period of exposure of the rotatable component to the printing fluid may be calculated, for instance the number of revolutions of the rotatable component and/or the machine revolutions.

Further advantages of the invention are that it saves detergent, cleaning cloth and/or water and in particular shortens the time required for set-up operations. Another advantage of the invention is that the use of the wrong detergent and the related problems may be avoided.

Preferred further developments of the invention may be distinguished by one or more of the features listed below:

- the cleaning process may preferably be a washing process, preferably a washing process using water and/or detergent and, if desired, a cleaning cloth.
- Preferred steps in an execution of the cleaning operations are to apply a cleaning fluid and to remove it together with the fluid and/or dirt.
- The predefined cleaning operations are preferably saved on the computer and are preferably executed by a cleaning device controllable by the computer.
- Each one of the predefined cleaning operations preferably includes an individual succession of successive cleaning steps of individual duration, for instance the steps of washing, rinsing, and/or drying. Multiple cycles, potentially alternating cycles, of such successions may be provided.
- The automated selection is preferably made by the computer.

The mathematical model may preferably be based on a known general model that is specifically adapted to the actual structure of the printing press and/or the printing unit/printing units thereof. The model may represent a computational simulation of the printing press wherein at least the relevant, i.e. fluid-bearing and fluid-transferring components of the machine as well as the printing material are simulated. The simulation may preferably represent the transfer of fluid and/or dirt.

The calculated parameter is preferably used to select one of several predefined cleaning operations. It is possible and preferred to calculate and jointly use several such parameters. For instance, a table representing an association between the calculated parameter or calculated parameters (or ranges of parameters) and the predefined cleaning operations may be available on the computer.

The calculated parameters may preferably be the amount, for instance the film thickness, of the printing fluid that is present on the surface of the rotatable component to be cleaned.

The model may preferably be executed in parallel with the operation of the printing press, for instance in parallel with the processing of a print job.

The method may preferably select the instant of initiation of the cleaning operation and/or the duration thereof.

The method may factor in the fact that printing fluid may get from one printing unit to a downstream printing unit through the printing material.

The method may be part of a control operation of the printing machine.

Another preferred development of the invention may be that the parameter represents the film thickness of a printing fluid.

A further preferred development of the invention may be that the printing fluid is at least one printing ink, for instance a UV-curable printing ink or a non-UV-curable or other conventional printing ink or at least one dampening fluid.

An added preferred development of the invention may be that when calculating the parameter, the mathematical model factors in predefined transfer rates of the printing fluid between at least two rotatable components.

An additional preferred development of the invention may be that when calculating the parameter, the mathematical model factors in predefined transfer rates of the printing fluid between two respective ones of a plurality of rotatable components of a printing unit of a printing press.

Another preferred development of the invention may be that when calculating the parameter, the mathematical model factors in predefined transfer rates of the printing fluid between the printing material and at least one rotatable component.

A further preferred development of the invention may be that when calculating the parameter, the mathematical model factors in predefined transfer rates of the printing fluid between two respective ones of a plurality of rotatable components of multiple printing units of the printing press.

An added preferred development of the invention may be that when calculating the parameter, the mathematical model factors in a turning of the printing material.

An additional preferred development of the invention may be that the predefined cleaning processes differ from one another in terms of the use of different detergents.

A concomitant preferred development of the invention may be that the predefined cleaning processes differ from one another in terms of duration.

Other features which are considered as characteristic for the invention are set forth in the appended claims.

Although the invention is illustrated and described herein as embodied in a method for cleaning a printing fluid off a surface of at least one rotatable component of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
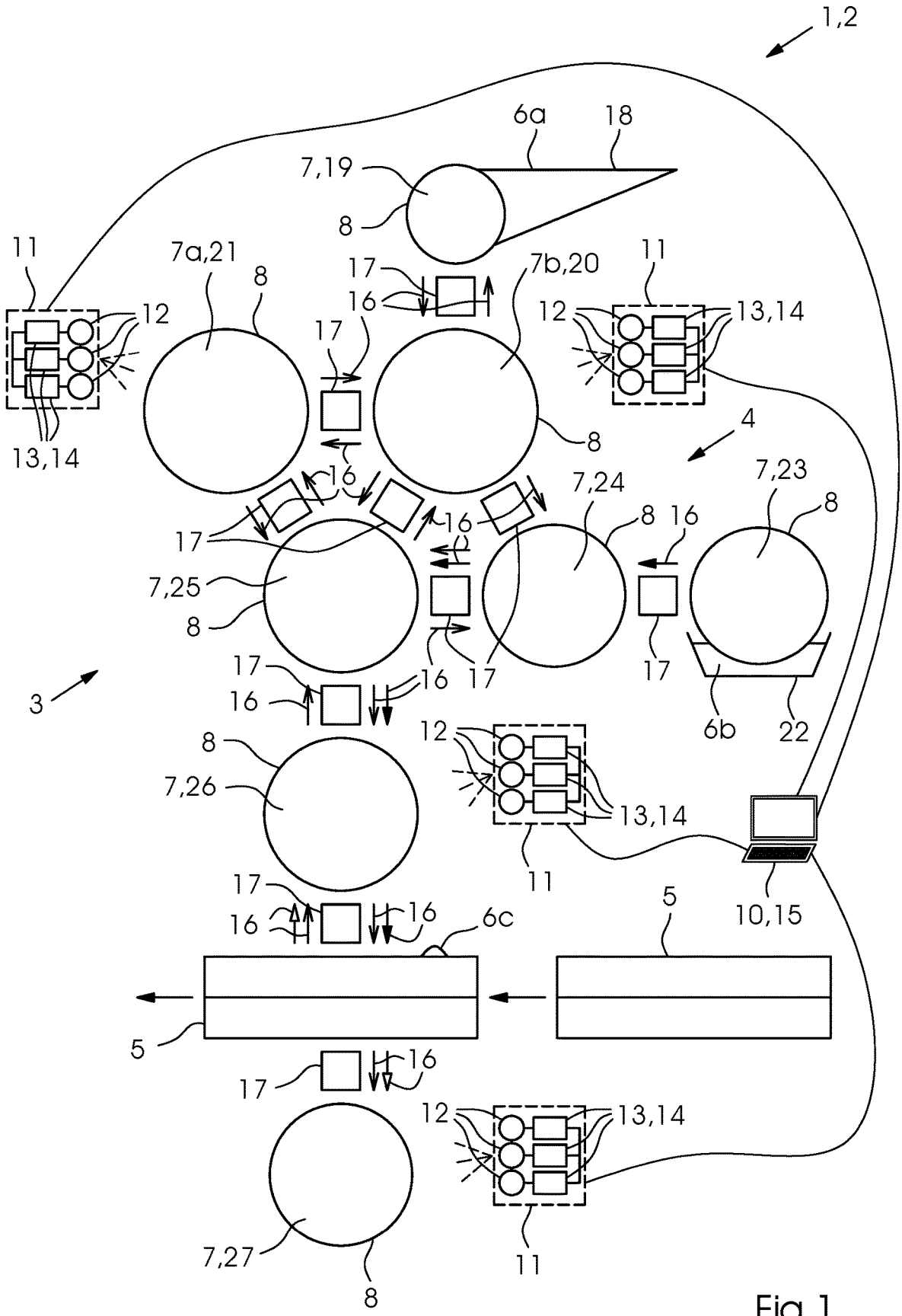
FIG. 1 is a schematic view of a printing unit in a printing press illustrating a preferred exemplary embodiment of a method of the invention.

Referring now in detail to the figures of the drawings, in which features that correspond to one another are indicated by the same reference numeral, and first, particularly, to FIG. 1 thereof, there is seen a schematic representation of a printing unit 2 in a printing press 1, in particular a lithographic offset printing press, including a roller-type inking unit 3 and a dampening unit 4. The printing press prints at least one printing ink 6*a* onto sheets 5, for instance made of paper, paperboard, cardboard, or a plastic film. A preferred embodiment of the method of the invention may be executed in the illustrated printing press.

The printing press 1 includes a plurality of rotatable components 7, for instance cylinders and/or rollers, and further components: an ink fountain 18, an ink fountain roller 19, a first inking roller group 20, a second inking roller group 21, a dampening fluid fountain 22, a dampening fluid roller 23 (dipping roller and/or metering roller), a dampening fluid applicator roller 24, a plate cylinder 25, a blanket cylinder 26, and an impression cylinder 27.

The method of the invention is used to clean surfaces 8 of at least one of such rotatable components 7. The surface may be a cylinder surface or a roller surface. Instead, it may also be the surface of a cover of the component capable of rotating, for instance a rubber blanket surface.

Cylinders and/or rollers may be combined to form groups 7*a* and 7*b*, for instance a first inking roller group 7*a* and/or a second inking roller group 7*b*, each of which may include several inking rollers. The grouping makes sense and simplifies the calculations of the model because the individual rollers of each group are always engaged with one another.

In the cleaning operation, a printing fluid such as the printing ink 6*a* or a dampening fluid 6*b* is removed from the surface 8, preferably by washing and in particular by washing with an aqueous detergent. In the cleaning operation, dirt 6*c*, in particular paper dust, may additionally be removed from the surface.

The printing press 1 includes a computer 10, for instance a control unit or controller. The computer is connected to at least one cleaning device 11 and controls the operation thereof, for instance when the cleaning device is switched on and off, how intense the executed cleaning operation is, how long it takes, how often detergent is sprayed, etc.

The cleaning device 11 may include multiple spraying tubes 12 and every spraying tube may be connected to a detergent container 13. The various detergent containers may contain different detergents 14, for instance detergents for conventional offset inks or for UV inks. The cleaning device may additionally include a cleaning cloth and/or a rotatable cleaning brush and/or a doctor blade. It is possible to provide several cleaning devices 11 inside the printing press 1 or the printing units 2 thereof.

A dynamic mathematical model (or simulation model) is stored on the computer 10 in digital form, for instance in the form of a computer program. The model preferably represents the transfer of fluid or fluids in the printing press 1 and/or the printing unit or printing units 2.

An arrow 16 in FIG. 1 represents the respective transfer of a fluid 16 such as printing ink, varnish, or dampening fluid, or even a mix of such fluids, between two rotatable components, for instance cylinders and rollers, or between the printing material and rotatable components: the simple-tip arrow indicates the transfer of printing ink and/or varnish, the black-tipped arrow indicates the transfer of dampening fluid, and the white-tipped arrow indicates the transfer of dirt/paper dust.

The transfer 16 occurs in a line of contact 17 between two respective rotatable components 7. The lines of contact are preferably switchable, i.e. at least one of the two components may be engaged with and disengaged from the other component. In a line of contact, the respective transfer 16 may occur in one of the two possible directions of transfer (from component a to component b or vice versa) or in both directions (from component a to component b and vice versa). For example: At the line of contact between the blanket cylinder 26 and the printing material 5, the configuration and orientation of the arrows indicates that printing ink and dirt are transferred from the printing material to the cylinder and printing ink and dampening fluid are transferred from the cylinder to the printing material. This analogously applies to all other arrows.

The mathematical model 15 preferably models the physical processes of fluid transfer, for instance by fluid splitting, on the basis of predefined formulas. In this context, the assumption may be made that in a line of contact 17, a fluid film is split in half (50% of the fluid remains on component a and 50% is transferred to component b).

The mathematical model 15 accesses transfer rates A (which are preferably available on the computer 10). Each one of these transfer rates A is dependent on a first rotatable component and a second rotatable component or from a rotatable component and a printing material and on the respective surface properties thereof (acceptance and release behavior). These transfer rates may preferably be available on the computer or in the model as respective percentages for every line of contact 17. The transfer of fluid (and of dirt) between two rotatable components 7 may be calculated in the model as follows: transfer=A*(film thickness on the first rotatable component−film thickness on the second rotatable component). This analogously applies to the transfer between printing material and a rotatable component. The first rotatable component is the starting point and the second rotatable component is the destination of the fluid transfer. The calculations may be made iteratively and may represent changing conditions (fluid film thicknesses). The calculations may also factor in cleaning operations that may cause local fluid film thicknesses on the cleaned component (and on potential further components engaged with the component in question) to drop to zero.

The following examples are intended to illustrate this transfer:

transfer of printing ink from the first inking roller group 20 to the plate cylinder 25: A=5%;

transfer of printing ink from the plate cylinder 25 to the blanket cylinder 26: A=50%;

transfer of printing ink from the blanket cylinder 26 to sheet the 5: A=10%;

transfer of dampening fluid from dampening fluid applicator roller 24 to the plate cylinder 25: A=50%; and transfer of dirt from the sheet 5 to the impression cylinder 27: A=30%.

The mathematical model 15 may furthermore factor in that one or more maximum values that indicate the maximum amount of printing ink, dampening fluid, and/or dirt that may be present on the surface of the rotatable component 7 are assigned to every rotatable component 7 (and are as such predefined and available on the computer 10).

Some examples:

A value max_ink=5 (maximum ink value) and a value max_dampeningfluid=5 (maximum dampening fluid value) may be assigned to the plate cylinder 25;

A value max_ink=40 may be assigned to the first inking roller group 20; and the values max_ink=1, max_dampeningfluid=1 and max_dirt=1 (maximum dirt/paper dust value) may be assigned to the sheet 5.

The mathematical model 15 has access to corresponding A values for every arrow 16 shown in FIG. 1. The available percentages may be determined in advance by taking measurements.

The mathematical model 15 allows the amount of fluid (printing ink, dampening fluid) and/or dirt to be calculated that is present on the surface 8 of every rotatable component 7 at a specific instant. This calculation may be made at any time or it may be continuously updated. For this purpose, the transfer of fluid/dirt is calculated in a computer-assisted way, i.e. the computer simulates the actual transfer. Thus, the mathematical model may be considered a simulation model.

The method of the invention allows one of several predefined cleaning operations to be selected and executed in an automated way on the basis of such a model/such a simulation. As mentioned above, for this purpose, the respective cleaning device 11 may include several spraying tubes 12 and several detergent containers 13. For instance, when the first inking roller group 20 is to be washed, the mathematical model 15 or rather a corresponding simulation of the printing machine 1 and the transfer of fluid/dirt thereof is used to make a computer-assisted calculation of the type of fluid/fluids and the amount of the fluid/fluids (e.g. film thicknesses) that are present on the surfaces 8 of the rollers in the group at the beginning of the cleaning process. Based thereon, a suitable detergent 14, for instance a detergent for conventional printing ink or for UV printing ink, the amount of detergent, and the duration of the washing operation as well as potential further cleaning parameters are selected.

The mathematical model 15 may factor in the "history" of the switching positions between the rotatable components 7 (and the printing material 5), thus being able to reproduce the current condition in a near-perfect way. For this purpose, the mathematical model 15 is provided with all information on switching operations between the rotatable components 7 (and the printing material 5), for instance with information on which components are engaged with which other components at what time and for how long (how many revolutions).

In this way, the mathematical model 15 may suggest an optimum predefined washing program. Alternatively, a predefined washing program may be optimally adapted in this way.

Cleaning devices 11 may, for instance, be provided on the following components: first inking roller group 20, second inking roller group 21, blanket cylinder 26, and/or impression cylinder 27.

The following is a description of a typical application:

1. Starting conditions: inking unit, dampening unit, blanket cylinder, impression cylinder have been washed; the ink fountain is empty.
2. The operator fills ink into the ink fountain.
3. The ink is fed in automatically.
4. Current conditions: ink is present in the ink fountain, in the inking unit, on the plate; the blanket is clean, the impression cylinder is clean.
5. The production run is started: sheets enter the press.
6. The plate cylinder and the blanket cylinder are engaged with one another.
7. Current conditions: ink is present in the ink fountain, in the inking unit, on the plate, on the blanket; the impression cylinder is clean.
8. The first sheet reaches the printing unit and receives a print.
9. Current conditions: ink is present in the ink fountain, in the inking unit, on the plate, on the blanket; the impression cylinder is dirty.

The input variables for the dynamic model are the current switching states of the printing unit components. Every step of such an application case may be simulated in the model.

Figure 2:
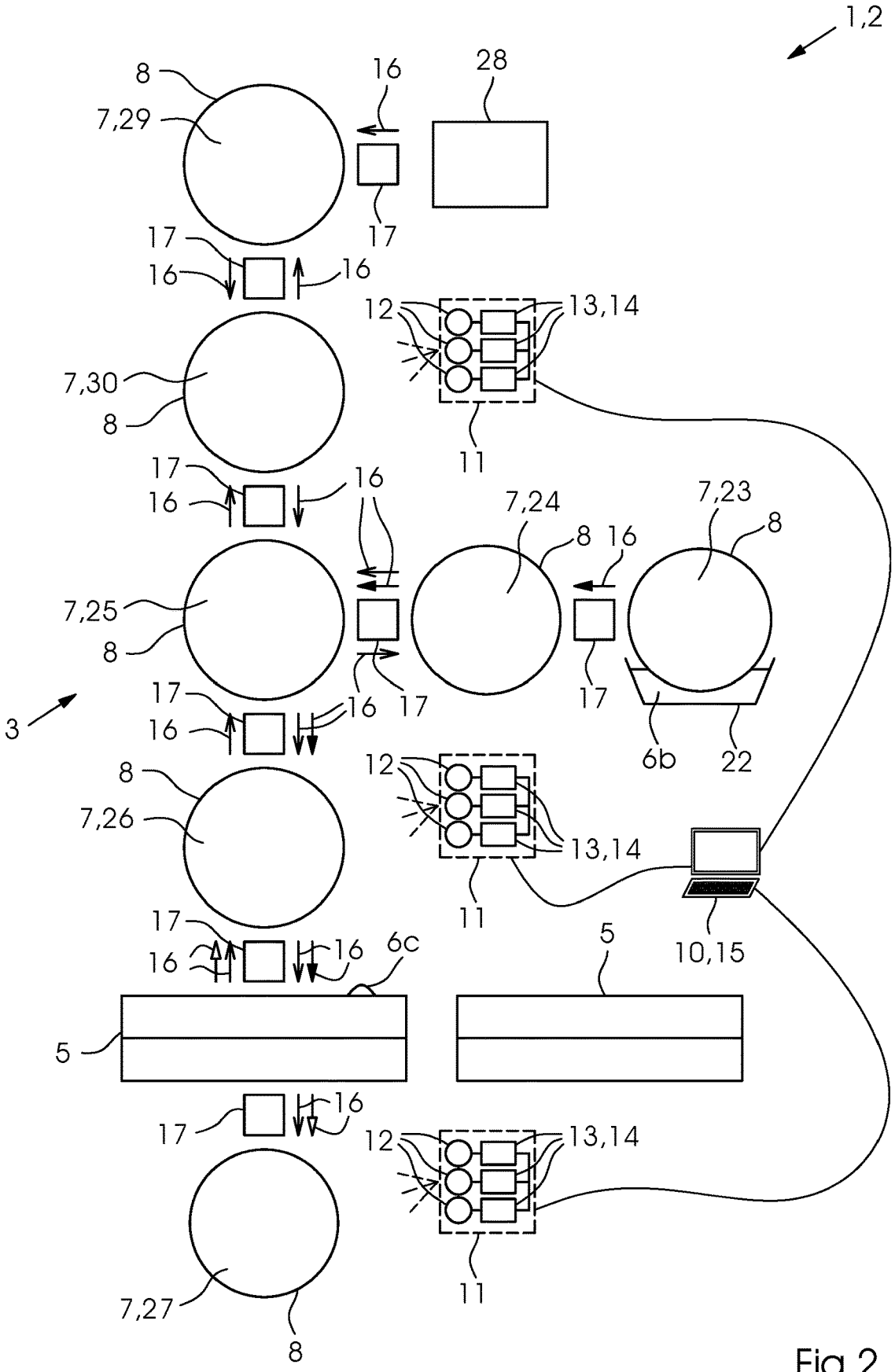
FIG. 2 is a view similar to FIG. 1 illustrating another preferred exemplary embodiment of a method of the invention.

FIG. 2 illustrates a further preferred embodiment of the invention for a printing press 1 with a screen roller inking unit 3 (anilox inking unit). (In contrast to FIG. 1,) the inking unit includes a blade-type ink fountain 28, a screen roller 29 and an ink applicator roller 30. In this embodiment, the mathematical model 15 is likewise capable of calculating/simulating the amount of fluid and/or dirt on a specific rotatable component 7, for instance on the ink applicator roller 30, at any given point based on the predefined transfer rates A and of automatically selecting and carrying out an optimal washing program for cleaning the component in question.

The invention may alternatively be used in varnishing units, inkjet printing units, and other sheet-guiding devices.

Figure 3:
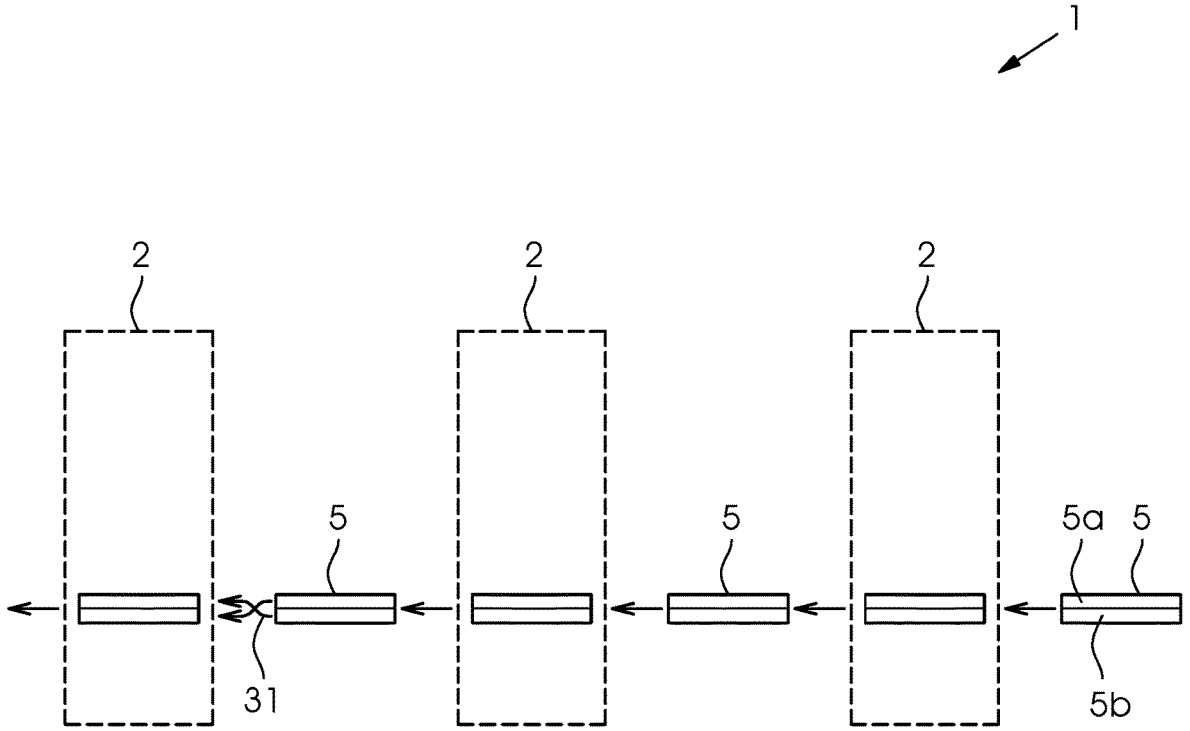
FIG. 3 is a block diagram illustrating a further preferred exemplary embodiment of a method of the invention.

FIG. 3 illustrates a further embodiment of the invention for a printing machine 1 having multiple printing units 2. A sheet 5 having a top side 5*a* and a bottom side 5*b* is conveyed to a first printing unit 2, for instance by using cylinders. In the first printing unit, ink is printed onto the top side, causing this side to be the straight-printing side 5*a*. Then the sheet is conveyed to the second printing unit 2 and likewise receives a print on the straight-printing side 5*a*, preferably in a different color. Finally, the sheet 5 is conveyed onwards and turned, preferably by using a turning device 31. In the third printing unit, ink is printed onto the bottom side 5*b*, causing this side to be the perfecting side 5*b*.

This exemplary embodiment illustrates that the mathematical model 15 is even capable of factoring in the facts that fluid and/or dirt may be transferred from one printing unit 2 to another printing unit 2 through the substrate and that "top" and "bottom" sides may change in the process (when the turning mode is active). In this way, a first ink from a first printing unit 2 may get into a second printing unit 2 and mix with the ink of the second printing unit 2. In this process, it is even possible for UV ink and conventional ink to get mixed, for instance. For such cases in particular it is advantageous that the invention provides an automated selection of the optimum cleaning program using the optimum detergent.

The invention may also be used when sheets are conveyed without printing. In this context, a blanket cylinder 26 in a printing unit 2 is engaged with an impression cylinder 27 in a printing unit 2, yet the plate cylinder 25 is not engaged with the blanket cylinder 26. Sheets are transported but not printed on in the printing unit 2. Therefore, the blanket cylinder 26, or rather the surface or cover thereof, only receives printing fluid 6*a*, 6*b* from upstream printing units through the transported sheets. Thus, the printing fluid film on the blanket cylinder is thinner than when it is in engagement with the plate cylinder and an adapted cleaning program, for instance a shorter one, may automatically be selected. The adapted cleaning program may additionally select a cleaning agent that works best with the printing fluid from the upstream printing units.

The following is a summary list of reference numerals and the corresponding structure used in the above description of the invention:

1 printing press
2 printing unit/printing units
3 inking unit
4 dampening unit
5 sheets of printing material/printing material
5*a* top side of the sheet/straight printing side
5*b* bottom side of the sheet/perfecting side
6*a* printing ink
6*b* dampening fluid
6*c* dirt/paper dust
7 rotatable component/cylinder/roller
8 surface
10 computer
11 cleaning devices
12 spraying tubes
13 detergent container
14 detergent
15 mathematical model
16 transfer of fluid/dirt
17 line of contact
18 ink fountain
19 ink fountain roller
20 first inking roller group
21 second inking roller group
22 dampening fluid fountain
23 dampening unit roller
24 dampening fluid applicator roller
25 plate cylinder
26 blanket cylinder
27 impression cylinder
28 blade-type ink fountain
29 anilox roller
30 ink applicator roller
31 turning device
A transfer rates

The invention claimed is:

1. A method for cleaning a printing fluid off a surface of at least one rotatable component of a printing press, the method comprising the following steps:

automatically selecting and executing one of a plurality of predefined cleaning operations by using a computer;

making the selection on a basis of a predefined mathematical model executed on the computer;

calculating a parameter corresponding to an amount of the printing fluid being present on the surface when executing the predefined mathematical model, the parameter being a film thickness of the printing fluid; and using the predefined mathematical model to factor in predefined transfer rates of the printing fluid between at least two rotatable components when calculating the parameter.

2. The method according to claim 1, wherein the printing fluid is at least one printing ink or a dampening fluid.

3. The method according to claim 1, which further comprises using the predefined mathematical model to factor in predefined transfer rates of the printing fluid between a respective two of a plurality of rotatable components of a printing unit of the printing press when calculating the parameter.

4. The method according to claim 1, which further comprises using the predefined mathematical model to factor in predefined transfer rates of the printing fluid between printing material and at least one rotatable component when calculating the parameter.

5. The method according to claim 1, which further comprises using the predefined mathematical model to factor in predefined transfer rates of the printing fluid between a respective two of a plurality of rotatable components of several printing units of the printing press when calculating the parameter.

6. The method according to claim 5, which further comprises using the predefined mathematical model to factor in a turning of printing material when calculating the parameter.

7. The method according to claim 1, wherein the predefined cleaning operations differ from one another in terms of using different detergents.

8. The method according to claim 1, wherein the predefined cleaning operations differ from one another in terms of duration.

* * * * *